US010807139B2

(12) United States Patent
Schremmer et al.

(10) Patent No.: US 10,807,139 B2
(45) Date of Patent: Oct. 20, 2020

(54) CUPPER DRAW PAD

(71) Applicant: Anheuser-Busch, LLC, St. Louis, MO (US)

(72) Inventors: Mark Schremmer, O'Fallon, MO (US); Scott Schaefer, St. Louis, MO (US); Mark Wagner, St. Louis, MO (US)

(73) Assignee: Anheuser-Busch, LLC, Saint Louis, MO (US)

( * ) Notice: Subject to any disclaimer, the term of this patent is extended or adjusted under 35 U.S.C. 154(b) by 676 days.

(21) Appl. No.: 15/241,838

(22) Filed: Aug. 19, 2016

(65) Prior Publication Data

US 2017/0050232 A1 Feb. 23, 2017

Related U.S. Application Data

(60) Provisional application No. 62/207,722, filed on Aug. 20, 2015.

(51) Int. Cl.
*B21D 22/20* (2006.01)
*B21D 22/28* (2006.01)
(Continued)

(52) U.S. Cl.
CPC ..... *B21D 22/20* (2013.01); *B21D 22/22* (2013.01); *B21D 22/28* (2013.01); *B21D 24/04* (2013.01); *B21D 51/26* (2013.01)

(58) Field of Classification Search
CPC ..... B21D 24/04; B21D 24/06; B21D 24/08; B21D 24/10; B21D 24/12; B21D 24/14;
(Continued)

(56) References Cited

U.S. PATENT DOCUMENTS 3,349,153 A * 10/1967 Beck ..... B21D 22/22 264/292
3,664,172 A * 5/1972 Cvacho ..... B21D 22/22 413/56
(Continued)

FOREIGN PATENT DOCUMENTS

DE 102011077328 A1 * 10/2012 ..... B21D 22/22
GB 2551514 A * 12/2017 ..... B21D 22/20
(Continued)

OTHER PUBLICATIONS

Machine Translation of JP02-112830, Translated Jan. 17, 2019, 3 Pages. (Year: 1990).*
(Continued)

*Primary Examiner* — Gregory D Swiatocha
(74) *Attorney, Agent, or Firm* — Foley & Lardner LLP

(57) ABSTRACT

A draw pad reduces instances and the extent of earing when a blank of metal is clamped and punched during a drawing process that results in the formation a cup-shaped body from the blank. A draw pad for a cupping press includes an inner surface that defines a draw aperture that is configured to receive a punch. The draw pad also includes a clamping surface that has a first force concentrating segment disposed circumferentially spaced apart from a second force concentrating segment, where each force concentrating segment includes a first arcuate groove and a second arcuate groove that is disposed concentric and radially spaced apart from the first arcuate groove.

22 Claims, 7 Drawing Sheets

(51) Int. Cl.
*B21D 24/04* (2006.01)
*B21D 22/22* (2006.01)
*B21D 51/26* (2006.01)

(58) Field of Classification Search
CPC ..... B21D 22/22; B21D 22/28; B21D 22/20; B21D 51/26
See application file for complete search history.

(56) References Cited

U.S. PATENT DOCUMENTS

| | | | | | |
|---|---|---|---|---|---|
| 3,789,649 | A * | 2/1974 | Clowes | B21D 22/22 413/69 |
| 4,316,379 | A | 2/1982 | Andersen | |
| 5,644,943 | A * | 7/1997 | Lanz | B21D 22/26 72/348 |
| 5,946,964 | A * | 9/1999 | Snyder | B21D 22/30 72/349 |
| 2015/0246384 | A1 * | 9/2015 | Ikeda | B21D 22/22 72/347 |

FOREIGN PATENT DOCUMENTS

| | | | | |
|---|---|---|---|---|
| GB | 2554514 | A * | 4/2018 | |
| JP | 2-112830 | A * | 4/1990 | |
| JP | 02112830 | A * | 4/1990 | |
| JP | 2-205208 | A * | 8/1990 | |
| JP | 02205208 | A * | 8/1990 | |
| JP | 7-88569 | A * | 4/1995 | |
| JP | 07088569 | A * | 4/1995 | |
| JP | 7-44678 | U * | 11/1995 | |
| JP | 2002192251 | A * | 7/2002 | |
| WO | WO-9948631 | A1 * | 9/1999 | B21D 22/22 |

OTHER PUBLICATIONS

Machine Translation of DE 102011077328, Translated Jan. 17, 2019, 8 Pages. (Year: 2012).*
Machine Translation of JPH0744678, Translated Oct. 25, 2018, 5 Pages. (Year: 1995).*
Machine Translation of JP02-205208, Translated Jan. 17, 2019, 3 Pages. (Year: 1990).*
Machine Translation of JP2002-192251, Translated Jan. 17, 2019, 6 Pages. (Year: 2002).*
Machine Translation of JP07-088569, Translated Jan. 17, 2019, 3 Pages. (Year: 1995).*
Hyperion Can Tooling Creative Solutions, Sandvik Hyperion. Sandvik AB, 16 pgs., 2014.

* cited by examiner

CUPPER DRAW PAD

CROSS REFERENCE TO RELATED APPLICATIONS

This application claims priority to U.S. Provisional Application for Patent Ser. No. 62/207,722, filed Aug. 20, 2015, which is hereby incorporated by reference.

TECHNICAL FIELD

This disclosure relates to a tool for use in manufacturing metal containers, and in particular, to a cupper draw pad that reduces earing during a drawing process.

Background of the Disclosure

Thin-walled, two-piece metal containers are often produced using drawing processes. In a drawing process, a flat circular blank of sheet metal, for example aluminum, is drawn through one or more drawing dies to form a shallow preform cup. The blank of sheet metal used to form the preform cup has a particular anisotropy, which is the directional variation of sheet metal's mechanical properties. In other words, the blank of sheet metal will react differently to stresses applied in one direction than it would to the same stresses applied in a different direction.

The drawing process employs a cupping press or a cupper. A circular blank is cut from a sheet of material and is positioned over a die cavity. The circular blank is held against a die by a cupper draw pad, and a punch pushes the blank into the cavity with enough pressure and force to form the blank into a cup-like shape. The anisotropic properties of the blank of sheet metal contribute to earing formation on the open end of a drawn cup. Earing is the formation of uneven or wavy edges at the open end of the drawn cup. The problem of earing is attributable to the drawing process, and the anisotropy of a blank of sheet metal is the predominate cause of earing. Ears are formed approximately 45 degrees from the rolling direction of the sheet. These ears are the last material to remain clamped in the drawing process. At that time, all the clamping forces concentrate on those ears and can cause them to become pinched or thinned. Earing is problematic in that it may cause material to be wasted, such as when the earing portion of the drawn cup needs to be cut away, or it may lead to undesirable metal portions that may disrupt downstream formation processes.

In order to reduce undesirable earing, non-round blanks are sometimes cut from the sheet of metal. Non-round blanks, however, often have less material available approximately forty-five degrees to the material grain, i.e., the direction the sheet metal was rolled, and require more complex and expensive tooling in the cupping press and in downstream manufacturing processes.

SUMMARY

According to the teaching of the present disclosure, a draw pad reduces instances and extent of earing when a blank of metal is clamped and punched during a drawing process that results in a cup-shaped body. The ears that would be produced using a conventional cupping press with a conventional draw pad are reduced or eliminated, and therefore do not interfere in subsequent forming operations of the cup-shaped body, for example, forming operations that forms the cup-shaped body into a metal can or an elongated metal bottle-shaped container.

According to one embodiment, a draw pad for a cupping press includes an inner surface that defines a draw aperture that is configured to receive a punch. The draw pad also includes a clamping surface that has a first force concentrating segment disposed circumferentially spaced apart from a second force concentrating segment, where each force concentrating segment includes a first arcuate groove and a second arcuate groove that is disposed concentric and radially spaced apart from the first arcuate groove.

According to an alternate embodiment, a draw pad for a cupping press reduces earing formation in the drawn cup-shaped body. The draw pad includes an inner surface that defines a draw aperture that is configured to receive a punch. The draw pad also includes a clamping surface that has a first force concentrating segment that is circumferentially separated by a relief area from a second force concentrating segment, where each of the force concentrating segments include a first arcuate groove that is radially spaced apart by a first distance from an adjacent second arcuate groove. The relief area has a first arcuate groove that is radially spaced apart by a second distance from an adjacent second arcuate groove, where the second distance being greater than the first distance.

According to still another embodiment of the present disclosure, a method of forming a cup-shaped body with reduced earing includes the steps of positioning a sheet of metal between a draw pad and a blank-and-draw die. The sheet of metal is clamped between the draw pad and the blank-and-draw die by contacting a clamping surface of the draw pad to a portion of the sheet of metal. The clamping surface has four force concentrating segments that are each circumferentially equally spaced apart from an adjacent force concentrating segment. Each force concentrating segment includes a first arcuate groove and a second arcuate groove that is disposed concentric and radially spaced apart from the first arcuate groove. The sheet of metal is sheared to create a blank that has a disk shape. A punch is directed to displace a portion of the blank into a die cavity and thereby form the blank between the punch and the blank-and-draw die into a cup-like shape.

Technical advantages of the disclosed embodiments include a draw pad with specifically located relief areas that allow for more even distribution of gripping forces in areas of the metal blank that are most susceptible to earing. According to other embodiments, areas of a draw pad that contact a blank in locations that are susceptible to earing include depressions in the clamping surface that are generally in the shape of an ear that might be formed using conventional draw pads.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

A more complete understanding of the method and apparatus of the present invention may be acquired by reference to the following Detailed Description when taken in conjunction with the accompanying Drawings wherein.

DETAILED DESCRIPTION

Figure 1A:
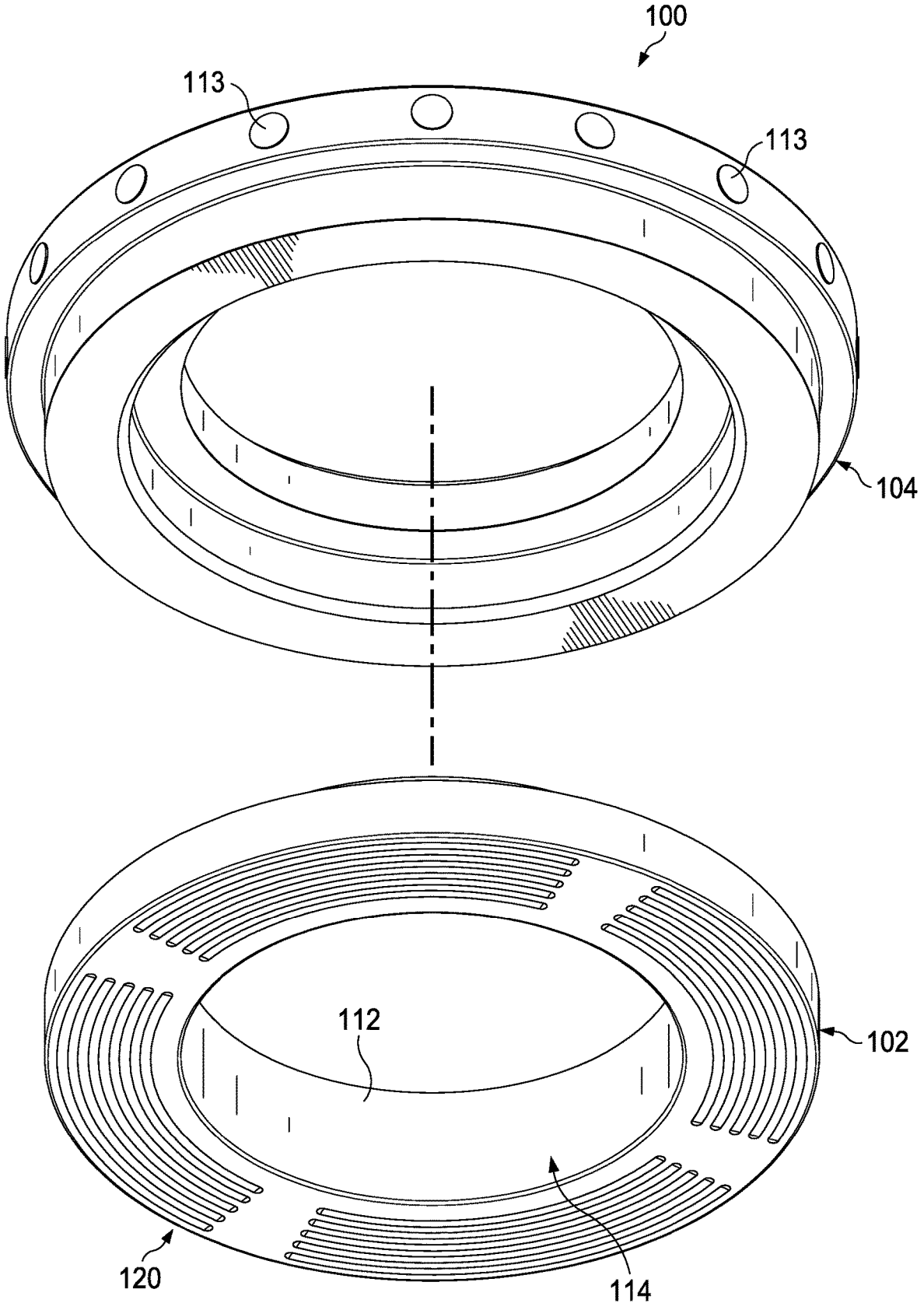
FIGS. 1A and 1B are exploded, perspective views of a draw pad and casing assembly in accordance with this disclosure.
Figure 1B:
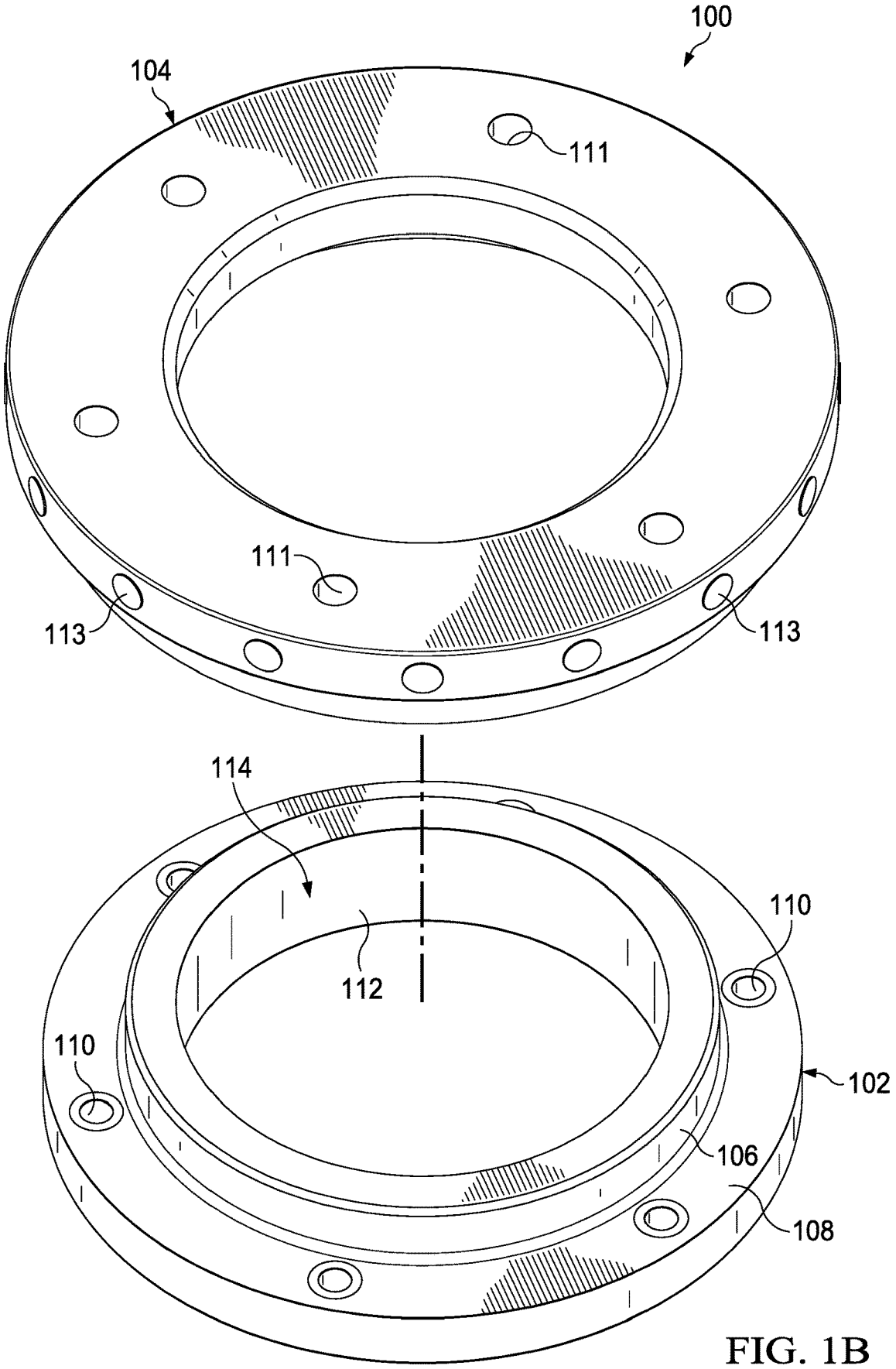

FIGS. 1A and 1B illustrate exploded, isometric views of a draw pad assembly 100, where FIG. 1A is a view toward a clamping surface 120, and FIG. 1B is a view in a direction opposite the view direction of FIG. 1A. The draw pad assembly 100 is part of a die assembly used in a drawing process. The draw pad assembly 100 includes a draw pad 102 and a casing 104. The draw pad 102 is formed of an ultra-hard material such as carbide, and the casing 104 is formed of a softer material. According to one embodiment, the draw pad 102 is formed of a carbide material with a nickel binder, and the casing 104 is formed of tool steel. When a cup is formed, a metal sheet is clamped between the draw pad 102 and a blank-and-draw die to allow a punch to form the metal into a cup-like part as it forces the metal into a die cavity and the metal flows between the punch and the blank-and-draw die. The machine that includes the punch, the draw pad 102, the casing 104, and the blank-and-draw die is often referred to as a cupping press or a cupper because it is used to form hollow, cylindrical parts with an open end that resemble a cup. The draw pad 102 disclosed herein reduces the formation of ears, also referred to as earing, in the drawn cup.

Embodiments of the draw pad 102 of the present disclosure are used to form an elongated cup that undergoes subsequent metal forming operations, such as ironing and necking, and is formed into a metal can or a metal bottle-shaped container. A variety of different draw pad configurations may be used and the configurations may be based on the size and shape of the part to be drawn, the type of material used for the blank, as well as the type of drawing process employed. Some non-limiting, illustrative embodiments of draw pads that may be used in the draw pad assembly 100 are disclosed herein.

With reference to FIG. 1B, the draw pad 102 includes a neck portion 106, a shoulder portion 108, and one or more blind apertures formed in the shoulder portion 108. In certain embodiments, a threaded insert 110 is secured in the blind aperture. The neck portion 106 is in the form of a cylindrical ring extending from the shoulder portion 108. The neck portion 106, the shoulder portion 108 and the one or more apertures including the threaded insert 110 are configured to ensure a secure fit between the draw pad 102 and the casing 104. According to one embodiment, a fastener extends through a corresponding through hole 111 in the casing 104 and is threaded to the threads of the insert 110 to secure the draw pad 102 to the casing 104. In addition to or in lieu of attaching the casing 104 to the draw pad 102 using a threaded connector, the shoulder may include a back taper that can shrink-fit with the casing 104. An adhesive may also be used to further ensure that the draw pad 102 is securely attached to the casing 104. According to one embodiment, the casing 104 may include inserts 113, made of a resilient material, such as rubber, disposed around an outer perimeter of the casing 104. The resilient inserts 113 serve as bumper pads with respect to the cylinder of the cupping press that houses the casing 104.

The shoulder portion 108 typically has a diameter greater than the diameter of the neck portion 106. In some embodiments, the shoulder portion 108 has a diameter (outer diameter) that is approximately 7 inches. However, it should be appreciated that the diameter of the shoulder portion 108 may be greater than or less than 7 inches as needed by the die assembly. An inner surface 112 of the draw pad 102 defines a draw aperture 114 for receiving the punch (see FIG. 7). The draw aperture 114 is centrally located and has a circular shape. The draw aperture 114 may have a diameter of approximately 4.5 inches in some embodiments. However, it should be appreciated that the draw aperture 114 may have a diameter greater than or less than 4.5 inches. The inner surface 112 may be annular or ring-shaped resulting in a cylindrical draw aperture 114. The draw aperture 114, however, may take a number of shapes to include square, rectangular, oblong, or any other shape.

Figure 2:
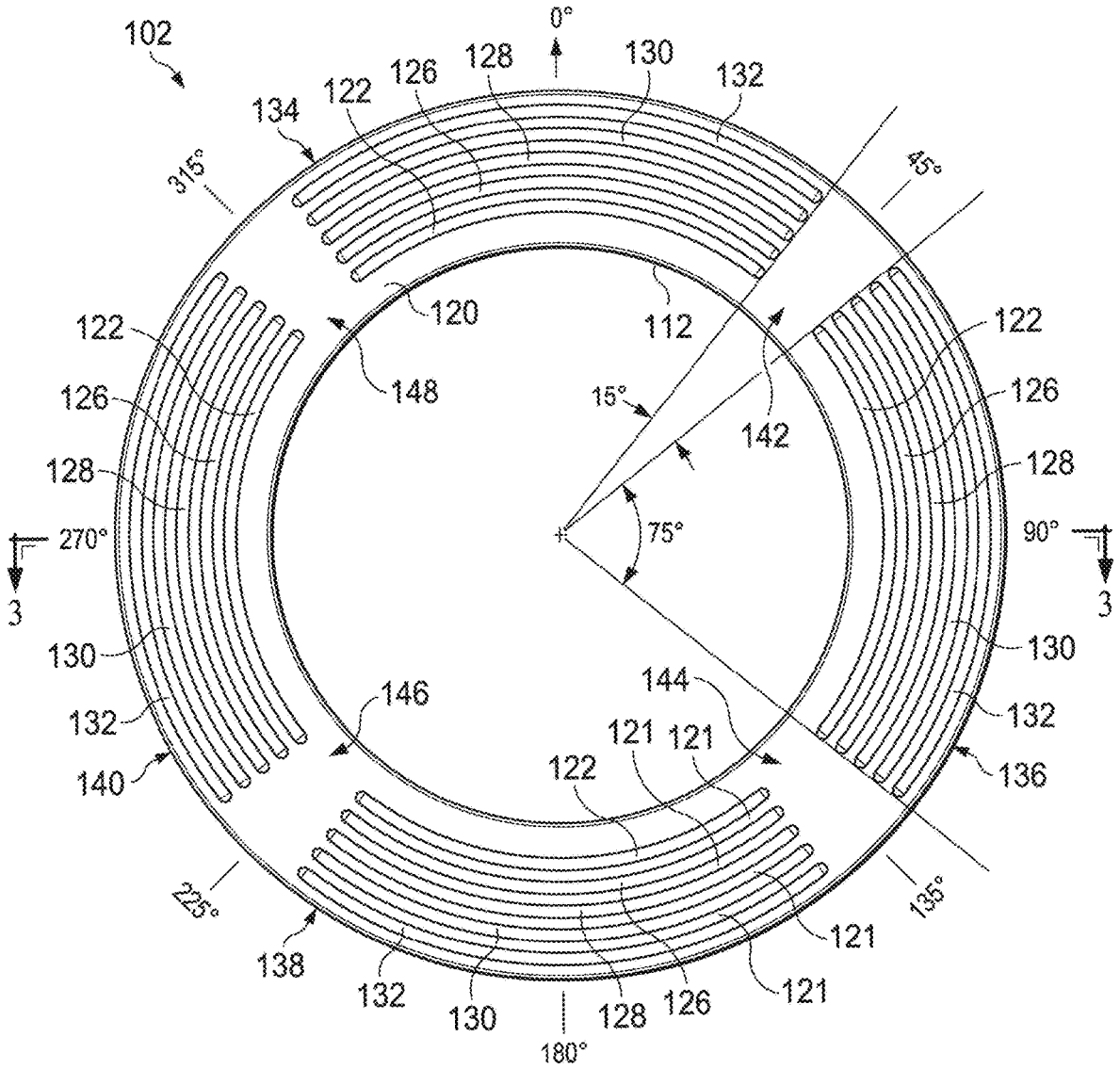
FIG. 2 is a plan view of a clamping surface of the draw pad of FIGS. 1A and 1B.
Figure 3:
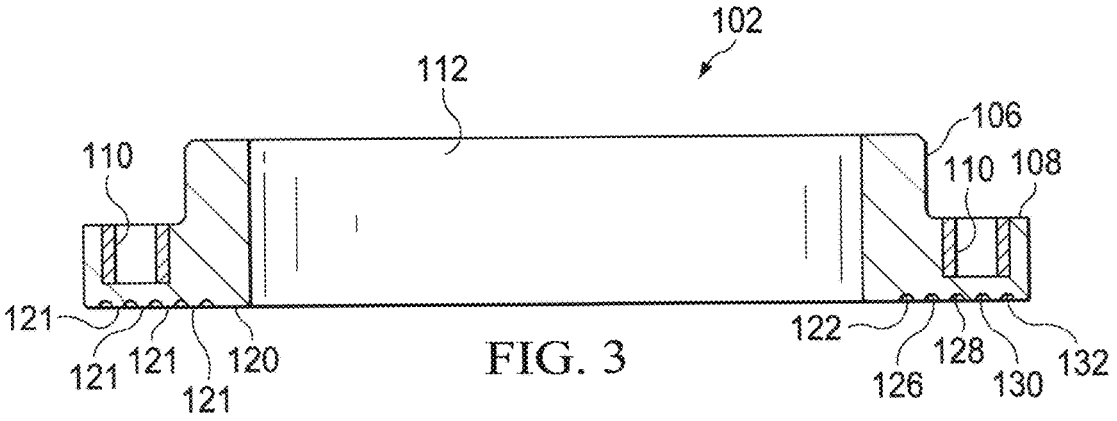
FIG. 3 is a section view of the draw pad of FIG. 2.

FIG. 2 illustrates a plan view of an embodiment of the draw pad 102 showing the clamping surface 120, and FIG. 3 illustrates a cross-sectional view of the draw pad 102 according to one illustrative embodiment. As discussed above, the draw pad 102 has a clamping surface 120 that is configured to be clamped or otherwise gripped against a blank to be formed into a cup-like shape through the drawing process.

The clamping surface 120 of the draw pad 102 includes at least a first annular row of grooves 122. In some aspects, the draw pad 102 further includes a second annular row of grooves 126, a third annular row of grooves 128, a fourth annular row of grooves 130, a fifth annular row of grooves 132, any combination thereof, or even more annular rows of grooves. In some aspects, the first annular row of grooves 122 is concentric to the draw aperture 114. In still some aspects, the first, the second, the third, the fourth and the fifth annular rows of grooves 122, 126, 128, 130, 132 are concentric to the draw aperture 114. The first, the second, the third, the fourth and the fifth annular rows of grooves 122, 126, 128, 130, 132 may be evenly spaced apart from each other along a radial direction or have varying radial distances from each other.

The annular rows of grooves are created by removing material from the clamping surface 120. A ridge 121 is disposed between radially adjacent grooves. In the area of the clamping surface 120 where the grooves are formed, the ridges 121 contact the blank during drawing. Thus, the clamping forces on the blank are concentrated by the ridges 121. It has been found that by creating relief areas by eliminating the grooves and thereby the ridges 121 in certain areas of the clamping surface 120, or reducing the grooves and increasing the surface area of the ridges 121, reduces the occurrence of earing as the drawing process is completed. More specifically, if the rolling direction of the material of the blank, such as rolled aluminum, is 0/180 degrees, then eliminating or reducing grooves at a position between 40-50 degrees, for example 45 degrees, from the rolling direction reduces earing in the drawn cup because the clamping forces are more evenly distributed in these relief areas.

Earing is commonly referred to as "45 degree ears" because they occur approximately 45 degrees from the rolling direction, but the actual location of earing for a particular metal blank may vary, for example from 40-50 degrees from the rolling direction and may not be exactly at 45 degrees from the rolling direction. Thus, the relief areas as shown and described throughout this disclosure are contemplated to be disposed between 40-50 degrees from the rolling direction.

In some aspects, the first, the second, the third, the fourth and the fifth annular rows of grooves 122, 126, 128, 130, 132 extend into the draw pad 102 at a depth of between 0.001 to 0.009 inches. In some aspects, the depth is 0.003 inches. The width of the first, the second, the third, the fourth and the fifth annular rows of grooves 122, 126, 128, 130, 132 may be approximately 0.09 inches. In some embodiments the width of the first, the second, third, the fourth and the fifth annular rows of grooves 122, 126, 128, 130, 132 may be greater than or less than 0.09 inches. For example, the width may be 0.01 to 0.1 inches. In yet some aspects, the first, the second, the third, the fourth and the fifth annular rows of grooves 122, 126, 128, 130, 132 each has a diameter of between 5 and 7 inches. In one embodiment, the first annular row of grooves 122 has a diameter of approximately 5.2 inches, the second annular row of grooves 126 has a diameter of approximately 5.5 inches, the third annular row of grooves 128 has a diameter of approximately 5.9, the fourth annular row of grooves 130 has a diameter of approximately 6.3, and the fifth annular row of grooves 132 has a diameter of approximately 6.7 inches.

Each annular row of grooves may be comprised of one continuous groove or be divided into multiple segments or individual grooves. As illustrated in FIG. 2 and according to an exemplary non-limiting embodiment, the first, second, third, fourth, and fifth annular rows of grooves 122, 126, 128, 130, 132 are divided into a first segment 134, a second segment 136, a third segment 138, and a fourth segment 140 where each segment is separated from an adjacent segment by a relief area that interrupts or otherwise bisects or divides the annular row of grooves.

Each of the segments 134, 136, 138, and 140 is a force concentrating segment because the arcuate grooves in each segment create the ridges 121, which concentrate the clamping force in the area of the blank in contact with the force concentrating segments 134, 136, 138, and 140. The ridges 121 do not extend above the surface of the clamping surface, so they may be more accurately described as force concentrating regions 121 that are located between adjacent radially spaced apart arcuate grooves. For example, a force concentrating region 121 is disposed between the first arcuate groove 122 and the radially spaced apart second arcuate groove 126 in each force concentrating segment.

Relief areas or force distributing segments, such as the at least one relief area 142, are positioned between the segments or in the annular row of grooves. In some aspects, there are multiple relief areas. As illustrated in FIG. 2, the first relief area 142 is positioned between the first segment of grooves 134 and the second segment of grooves 136, a second relief area 144 is positioned between the second segment of grooves 136 and the third segment of grooves 138, a third relief area 146 is positioned between the third segment of grooves and the fourth segment of grooves 140, and a fourth relief area 148 is positioned between the fourth segment of grooves 140 and the first segment of grooves 134. In this embodiment, the relief areas 142, 144, 146, 148 are coplanar with the ridges 121. In other words, the relief areas 142, 144, 146, 148 lack any groove or indentation into the clamping surface 120.

The first relief area 142, the second relief area 144, the third relief area 146, and the fourth relief area 148 are in some aspects, positioned equal distance apart. In an illustrative embodiment, the first, second, third and fourth relief area 142, 144, 146, 148 are positioned between 40-50 degrees offset, for example 45 degrees offset, from the rolling direction of the aluminum, which is 0/180 degrees. Thus, the relief area 142 is shown centered at 45 degrees, the second relief area 144 is shown centered at 135 degrees, the third relief area 146 is shown centered at 225 degrees, and the fourth relief area is shown centered at 315 degrees. However, a first relief area 142 positioned at 40-50 degrees, a second relief area 144 positioned at 130-140 degrees, a third relief area 146 positioned at 220-230 degrees, and a fourth relief area 148 positioned at 310-320 degrees are contemplated by this disclosure. The first, second, third and fourth relief areas 142, 144, 146, 148 may each be between 10 and 20 degrees wide. In an illustrative embodiment, the first, second, third and fourth relief areas 142, 144, 146, 148 are approximately 15 degrees wide. Hence, the space between the segments 134, 136, 138, 140 of the first row of grooves 122 is less than the space between the segments 134, 136, 138, 140 of the fifth row grooves 132. The relief areas ultimately reduce the height and pinching of those ears in the drawn material by reducing or more evenly distributing the clamping forces in the regions of the blank corresponding to the relief areas 142, 144, 146, and 148, also referred to as the force distributing segments, of the draw pad 102.

Figure 4:
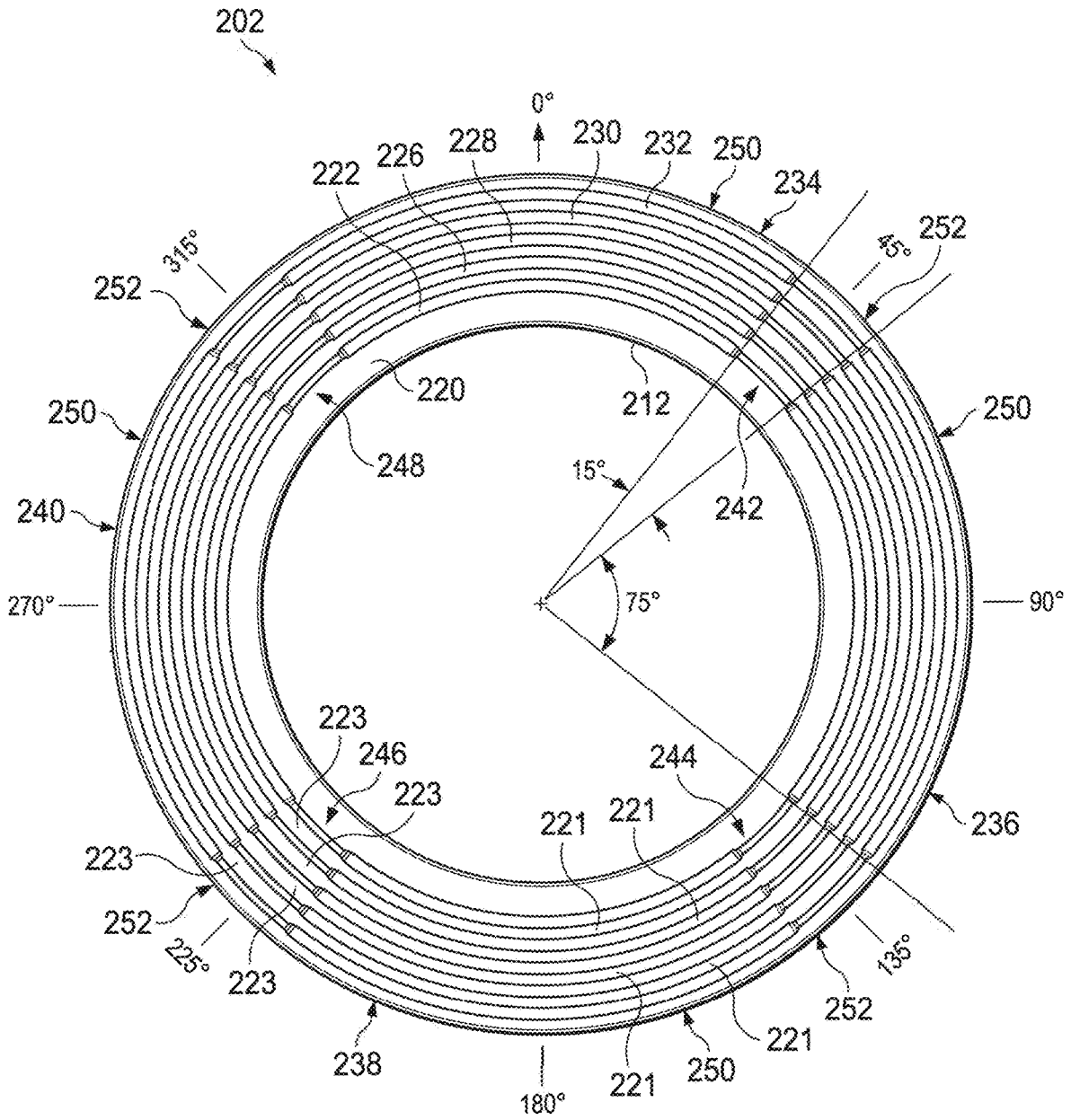
FIG. 4 is a plan view of a clamping surface of an alternate embodiment of a draw pad according to the present disclosure.

Referring now to FIG. 4, another embodiment of a draw pad 202 is presented. FIG. 4 illustrates a plan view of the draw pad 202 showing the clamping surface 220. The draw pad 202 is used with a cupping press and is attached to a casing as described above with respect to FIGS. 1A-3. The draw pad 202 also includes the same features as described above with respect to FIGS. 1A-3, which allows the draw pad 202 to be attached to the casing 104. The difference between the draw pad 202 and the draw pad 102 lies in the features of the clamping surface 220, and more specifically the relief areas of the clamping surface, as described in greater detail below.

The clamping surface 220 of the draw pad 202 includes at least a first annular row of grooves 222. In some aspects, the draw pad 202 further includes a second annular row of grooves 226, a third annular row of grooves 228, a fourth annular row of grooves 230, a fifth annular row of grooves 232, any combination thereof, or even more annular rows of grooves. Each annular row of grooves is radially spaced apart from an adjacent annular row of grooves.

The first, the second, the third, the fourth and the fifth annular row grooves 222, 226, 228, 230, 232 may be evenly spaced apart from each other along a radial direction or have varying distances from each other. In some aspects, the first, the second, the third, the fourth and the fifth annular rows of grooves 222, 226, 228, 230, 232 are concentric to the draw aperture 214.

The annular grooves are created by removing material from the clamping surface 220 such that a ridge 221 or force concentrating region 221 is disposed between radially adjacent grooves. In the area of the clamping surface 220 where the grooves are formed, the ridges 221 contact the blank during drawing. Thus, the clamping forces on the blank are concentrated by the ridges 221. It has been found that by creating relief areas by reducing the radial width and optionally the depth of the grooves and thereby increasing the surface area of ridges 223 in certain areas of the clamping surface 220, the occurrence of earing is also reduced.

In some aspects, the first, the second, the third, the fourth and the fifth annular rows of grooves 222, 226, 228, 230, 232 extend into the draw pad 202 at a depth of between 0.001 to 0.009 inches. In some aspects, the depth is 0.003 inches. The width of the first, the second, the third, the fourth and the fifth annular rows of grooves 222, 226, 228, 230, 232 may be approximately 0.09 inches. In some embodiments, the width of the first, the second, the third, the fourth and the fifth annular rows of grooves 222, 226, 228, 230, 232 may be greater than or less than 0.09 inches. For example the width may be 0.01 to 0.1 inches. In yet some aspects, the first, the second, the third, the fourth and the fifth annular row of grooves 222, 226, 228, 230, 232 have a diameter of between 5 and 7 inches. In one embodiment, the first annular row of grooves 222 has a diameter of approximately 5.2 inches, the second annular row of grooves 226 has a diameter of approximately 5.5 inches, the third annular row of grooves 228 has a diameter of approximately 5.9 inches, the fourth annular row of grooves 230 has a diameter of approximately 6.3 inches and the fifth annular row of grooves 232 has a diameter of approximately 6.7 inches.

Each annular row of grooves may be comprised of one continuous groove that is divided into multiple segments with one or more relief areas circumferentially positioned therebetween. In an exemplary embodiment, the first, the second, the third, the fourth, and the fifth annular rows of grooves 222, 226, 228, 230, 232, are divided into a first segment 234, a second segment 236, a third segment 238, and a fourth segment 240.

Each of the segments 234, 236, 238, and 240 is a force concentrating segment because the arcuate grooves in each segment create the ridges 221, which concentrate the clamping force in the area of the blank in contact with the force concentrating segments 234, 236, 238, and 240. The ridges 221 do not extend above the surface of the clamping surface, so they may be more accurately described as force concentrating regions 221 that are located between adjacent radially spaced apart arcuate grooves. For example, a force concentrating region 221 is disposed between the first arcuate groove 222 and the radially spaced apart second arcuate groove 226 in each force concentrating segment.

At least one relief area interrupts or otherwise divides the segments. Relief areas are positioned between the segments or in the row of grooves. In some aspects, there are several relief areas. As illustrated, there is a first relief area 242 positioned between the first segment of grooves 234 and the second segment of grooves 236, a second relief area 244 positioned between the second segment of grooves 236 and the third segment of grooves 238, a third relief area 246 positioned between the third segment of grooves 238 and the fourth segment of grooves 240, and a fourth relief area 248 positioned between the fourth segment of grooves 240 and the first segment of grooves 234.

In an illustrative embodiment, the first, the second, the third and the fourth relief areas 242, 244, 246, 248 are grooves that interconnect two corresponding groove segments. The first relief area 242 includes grooves positioned between and joining the first segment of grooves 234 and the second segment of grooves 236. The second relief area 244 includes grooves positioned between and joining the second segment of grooves 236 and the third segment of grooves 238. The third relief area 246 includes grooves positioned between and joining the third segment of grooves 238 and the fourth segment of grooves 240. The fourth relief area 248 includes grooves positioned between and joining the fourth segment of grooves 240 and the first segment of grooves 234.

The grooves of the first, second, third and fourth relief areas 242, 244, 246, 248 may have a depth of approximately 0.001 inches and a width of approximately 0.05 inches. It should be appreciated that the depth may be greater than or less than 0.001 inches in the width may be greater than or less than 0.05 inches. The depth and the width of the grooves comprising the first, the second, the third and the fourth relief areas 242, 244, 246, 248 are smaller in size than the depth and the width of the first, the second, the third, the fourth and the fifth row grooves 222, 226, 228, 230, 232.

The first, the second, the third, and the fourth relief areas 242, 244, 246, 248 are in some aspects, positioned equal distance apart. In an illustrative embodiment, a center of each of the first, the second, the third and the fourth relief areas 242, 244, 246, 248 is positioned at 45 degrees, 135 degrees, 225 degrees, and 315 degrees, as illustrated. However, a first relief area 242 positioned at 40-50 degrees, a second relief area 244 positioned at 130-140 degrees, a third relief area 246 positioned at 220-230 degrees, and a fourth relief area 248 positioned at 310-320 degrees are contemplated by this disclosure. The first the second, the third and the fourth relief areas 242, 244, 246, 248 may each be between 10 and 20 degrees wide. In some aspects they may be 15 degrees wide.

According to the teaching of the present disclosure, the relief areas 242, 244, 246, 248 reduce earing in a drawn cup because they more evenly distribute the gripping force of clamping the blank than the groove segments 234, 236, 238, and 240. The relief areas include narrower (shorter radial width) and optionally shallower grooves that are further spaced apart from radially adjacent arcuate grooves than the arcuate grooves of the force concentrating segments 234, 236, 238, and 240, which increases the surface area of ridges 223 created by the grooves. The ridges 223 are the surfaces that contact the blank during clamping and increasing the surface area of the ridges 223 reduces the concentration of forces and more evenly distributes the clamping forces at the locations of the blank associated with earing.

Figure 5:
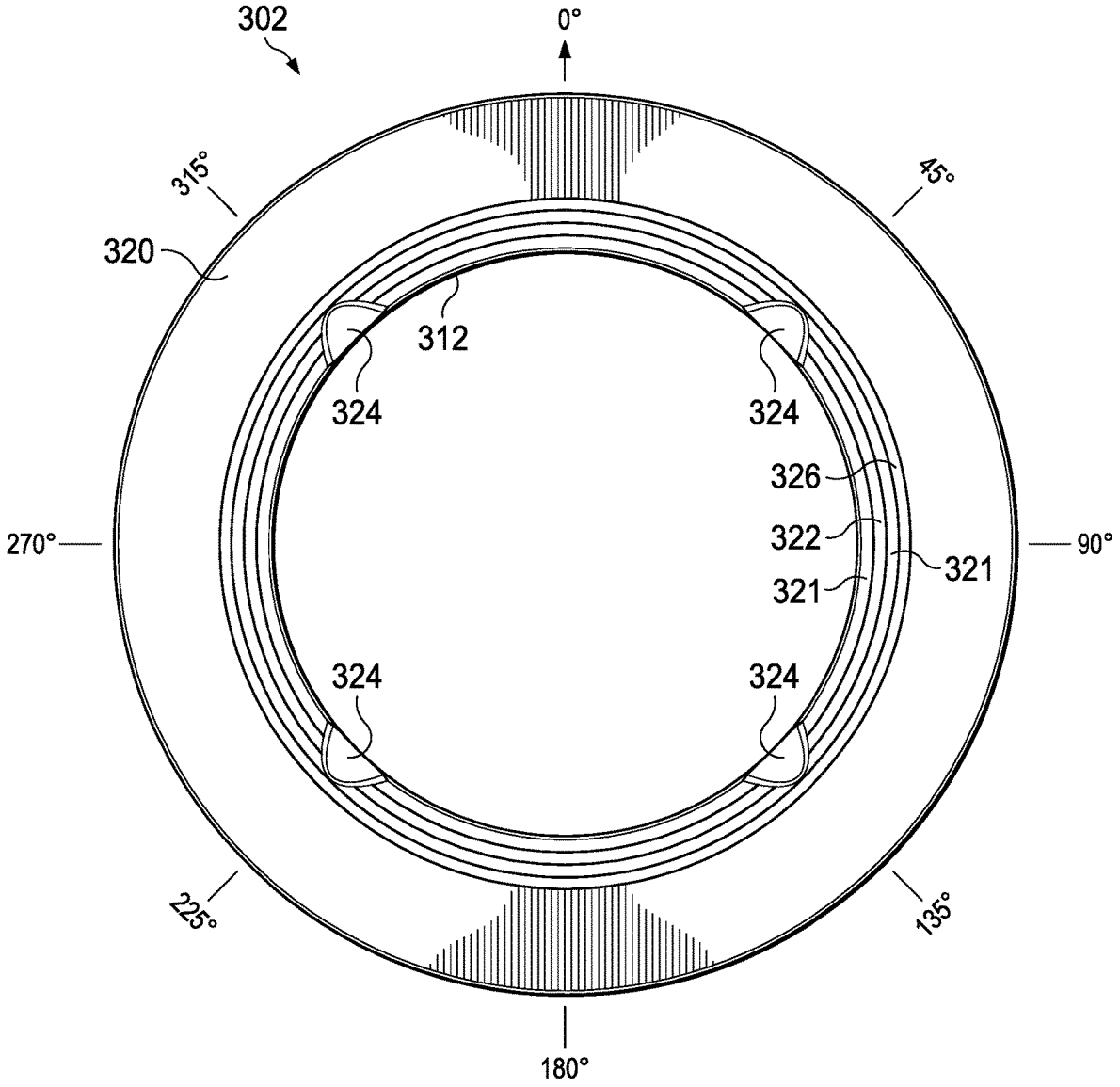
FIG. 5 is a plan view of a clamping surface of an additional alternate embodiment of a draw pad according to the teachings of the present disclosure.

Referring now to FIG. 5, another embodiment of a draw pad 302 is presented. FIG. 5 illustrates a plan view of the draw pad 302 showing the clamping surface 320. The draw pad 302 is used with a cupping press and is attached to a casing as described above with respect to FIGS. 1A-3. The draw pad 302 also includes the same features as described above with respect to FIGS. 1A-3, which allows the draw pad 302 to be attached to the casing 104. The difference between the draw pad 302 and the draw pad 102 lies in the features of the clamping surface 320, and more specifically the relief areas of the clamping surface 320, as described in greater detail below.

Similar to the other disclosed embodiments, the draw pad 302 includes a plurality of radially spaced annular grooves and a plurality of relief areas formed by removing material from the clamping surface at locations associated with earing of a metal sheet that has a 0/180 degree rolling direction. The draw pad 302 has a clamping surface 320 that is configured to be clamped or otherwise be gripped against a blank to be formed into a cup-like shape by a drawing process. The clamping surface 320 of the draw pad 302 includes at least a first annular groove 322. In some aspects, the draw pad 302 further includes a second annular groove 326 or more than two annular grooves, such as four or five annular grooves.

The clamping surface 320 further includes at least one relief area 324 that interrupts or otherwise bisects or divides the first annular groove 322. The relief area 324 is an area of the clamping surface 320 where material has been removed to form a depression in the clamping surface 320. The floor surface of the depression is a concave, tapered surface that is generally in a shape corresponding to a formed ear that might be created by conventional draw pads. The relief area tapers to increase in depth as it extends to the inner surface 312. In this embodiment, the at least one relief area 324 extends from the inner surface 312 and into the first annular groove 324. The at least one relief area 324 is created by removing material to create a depression in the clamping surface 320. In the embodiment shown, there are four relief areas, each with a center positioned 45 degrees offset from the rolling direction of the metal, for example a rolled aluminum. However, relief areas 324 positioned at 40-50 degrees, 130-140 degrees, 220-230 degrees, and 310-320 degrees are contemplated by this disclosure. Each of the relief areas 324 are spaced equal distance apart at approximately 90 degrees.

Similar to the embodiments described above, a ridge 321 is disposed between each radially spaced-apart groove, where the ridge 321 provides the contact surface that transmits the clamping force to the blank of metal, for example aluminum. In the non-relief areas, the ridges 321 concentrate the clamping force and localize the clamping force to be proportional to the surface area of the ridges 321. In contrast, the relief areas 324 relieve the clamping force at that particular area associated with earing. In using the draw pad 302 in a cupping press, as the blank is punched it is gripped by the ridges 321. As the punch continues to form the cup-like shape and the cup becomes deeper and the punch displacement is near its maximum, the ridges 321 release their respective grip as the blank tends to flow into the die cavity. At this point of the drawing process, the portions of the clamping surface 320 that would otherwise continue to grip the portions of the blank that are most likely to ear, are replaced with the relief areas 324, which reduces earing in the drawn cup.

According to the embodiment illustrated in FIG. 5, the annular grooves are disposed proximal to a center of the draw pad 302 in that the annular grooves are disposed toward an inner circumferential portion of the clamping surface 320 such that the annular grooves are directly adjacent the inner surface 312.

Figure 6:
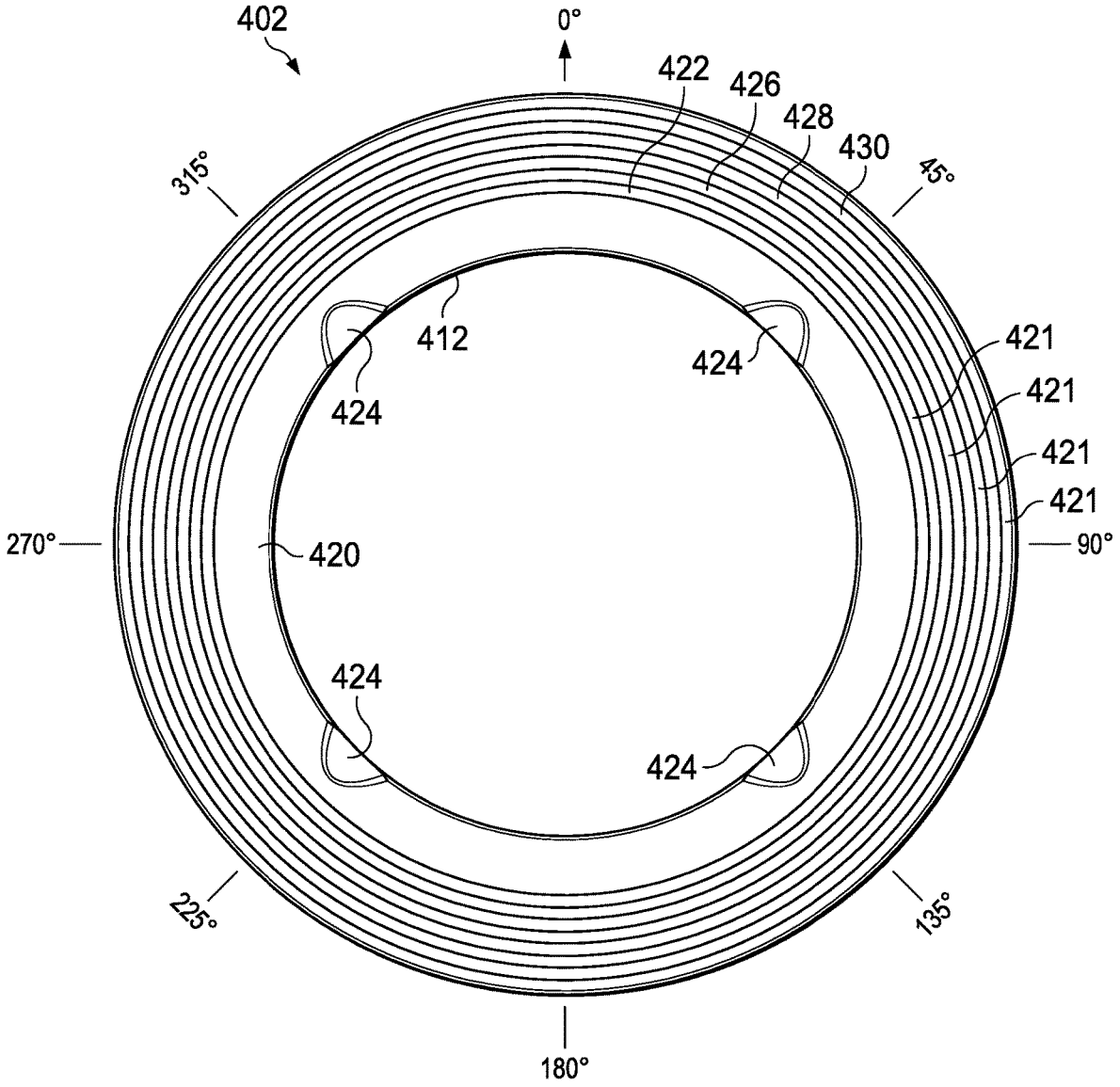
FIG. 6 is a plan view of a clamping surface of another alternate embodiment of a draw pad according to the teachings of the present disclosure.

FIG. 6 illustrates a clamping surface 420 of an embodiment of a draw pad 402. The draw pad 402 includes the same features as the draw pad 302 shown in FIG. 5, with the exception of the position of the concentric annular grooves. According to an embodiment, the draw pad 402 includes four concentric annular grooves disposed radially distal a center of the draw pad 402 on the clamping surface 420. According to this embodiment, the relief areas 424 are positioned, formed, and shaped as described above with respect to FIG. 5, but the relief areas 424 are radially internal to the annular grooves such that the relief areas 424 do not intersect the annular grooves.

Similar to the embodiments described above, a ridge 421 is disposed between each radially spaced-apart groove, where the ridge 421 provides the contact surface that transmits the clamping force to the blank of metal, for example aluminum. In the non-relief areas, the ridges 421 concentrate the clamping force and localize the clamping force to be proportional to the surface area of the ridges 421. In contrast, the relief areas 424 relieve the clamping force at that particular area associated with earing. In using the draw pad 402 in a cupping press, as the blank is punched it is gripped by the ridges 421. As the punch continues to form the cup-like shape and the cup becomes deeper and the punch displacement is near its maximum, the ridges 421 release their respective grip as the blank tends to flow into the die cavity. At this point of the drawing process, the portions of the clamping surface 420 that would otherwise continue to grip the portions of the blank that are most likely to ear, are replaced with the relief areas 424, which reduces earing in the drawn cup.

The clamping surface 420 of the draw pad 402 includes at least a first annular groove 422. In some aspects, the draw pad 402 further includes a second annular groove 426, a third annular groove 428, a fourth annular groove 430, any combination thereof, or even more annular grooves. The annular grooves 422, 426, 428, 430 extend into the draw pad 402 at a depth of between 0.001 to 0.009 inches. In some aspects, the depth is 0.003 inches. The width of the first, the second, the third and the fourth annular grooves 422, 426, 428, 430 may be approximately 0.09 inches in some embodiments, the width of the first, the second, the third, and the fourth annular grooves 422, 426, 428, 430 may be greater than or less than 0.09 inches. For example, the width may be 0.01 to 0.1 inches. In yet some aspects, the first, the second, the third, and the fourth annular grooves 422, 426, 428, 430 have a diameter of between five and seven inches. In one embodiment the first annular groove 422 has a diameter of approximately 5.6 inches, the second annular groove 426 has a diameter of approximately 5.9 inches, the third annular groove 428 has a diameter of approximately 6.3 inches and the fourth row grooves 430 has a diameter of approximately 6.7 inches.

Typically, the first, the second, the third, and the fourth annular grooves 422, 426, 428, 430 are continuous grooves that are unbroken by a relief area, as is generally the case in the previous embodiments. Similar to the other disclosed embodiments, the draw pad 402 includes a plurality of radially spaced annular grooves and a plurality of relief areas formed by removing material from the clamping surface at locations associated with earing of a metal sheet that has a 0/180 degree rolling direction.

The relief area 424 is an area of the clamping surface 420 where material has been removed to form a generally concave, tapered surface that is generally in a shape corresponding to a formed ear as might be created by conventional draw pads. The relief area 424 includes a floor surface that tapers to increase in depth as it extends to the inner surface 412. In this embodiment, the at least one relief area 424 extends from an inner surface 412 but does not intersect the first annular groove 422. The at least one relief area 424 extends into the clamping surface 420 of the draw pad 402. In the embodiment shown, there are four relief areas whose center is positioned 45 degrees offset from the rolling direction of the metal, for example a rolled aluminum. However, relief areas 424 positioned at 40-50 degrees, 130-140 degrees, 220-230 degrees, and 310-320 degrees are contemplated by this disclosure. Each of the relief areas 424 are spaced equal distance apart at 90 degrees.

Figure 7:
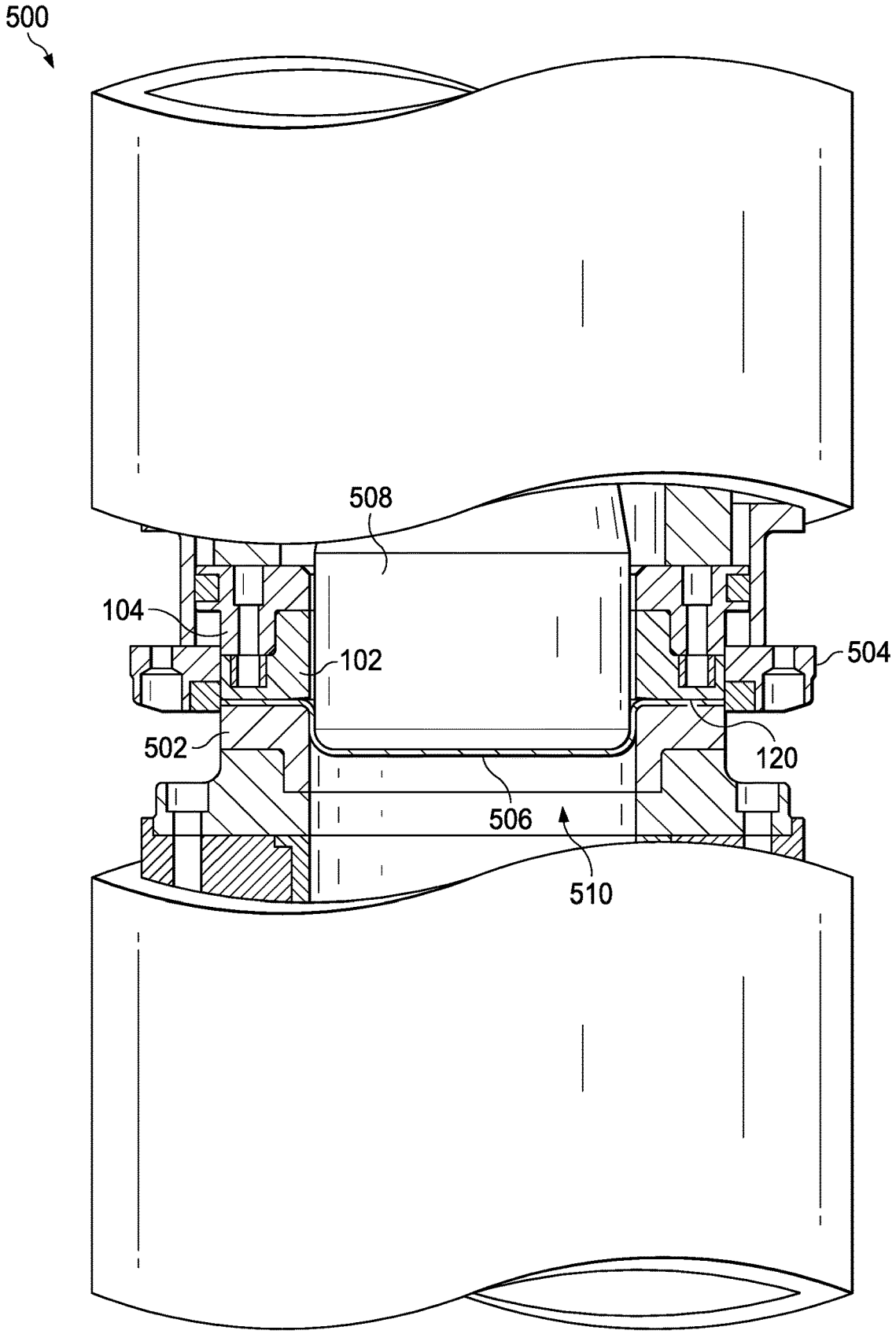
FIG. 7 illustrates a cupping press, with portions shown in section view, including a draw pad according to the teachings of the present disclosure.

Reference is made to FIG. 7, which is illustrates a cupping press or cupper 500 with portions shown in section view that comprise the draw pad assembly, which includes the casing 104 and one of the embodiments of the draw pad 102, 202, 302, 402, for example the draw pad 102, as disclosed herein. In operation, sheet metal, for example rolled aluminum, is fed through the cupper 500 to form into a cup-like shape through the drawing process. Upon dwelling the metal sheet in the cupper 500 is clamped between the draw pad 102 and a blank and draw die 502 to hold the metal sheet in place for subsequent forming operations. Specifically, the clamping surface 120 (or 220, 320, 420) as described in the multiple alternate embodiments of the present disclosure contacts the sheet metal to transmit a clamping force to sheet metal. Next, a blank cutter 504 is displaced to shear and cut away material to form a generally circular blank 506 from the sheet metal. According to alternate embodiments, the blank may be shaped other than circular.

After forming the blank 506, the blank continues to be clamped between the draw pad 102 and the blank and draw die 502 and the clamping surface 120 continues to transmit the clamping force. That is, the ridges 121 (or 221, 321, or 421) adjacent the annular grooves formed in the clamping surface 120 contact the blank 506. With the blank 506 clamped, the punch 508 is displaced and forces the blank 506 into the cavity 510 where the blank 506 is shaped between the punch 508 and the blank and draw die 502. As the punch 508 nears the full displacement, the relief areas 124 or 224, as taught herein, more evenly distribute the clamping force over the portions of the blank 506 that are most susceptible to earing, which is generally 45 degrees offset from the rolling direction. According to the alternate embodiment shown and described with respect to FIGS. 5 and 6, the relief areas 324 and 424 release the clamping force at the portion of the blank 506 that is most susceptible to earing.

The material used to form the blank is generally an anisotropic material, which has directional variations in the sheet metal's mechanical properties. In some materials, ears are formed approximately 45 degrees from the rolling direction of the sheet. These ears are the last material to remain clamped in the drawing process. At that time, all the clamping forces concentrate on those ears and can cause them to become pinched or thinned. The draw pads are clamped or gripped against the blank such that the relief areas are positioned at approximately 45 degrees offset from the rolling direction, such as a 0/180 degree rolling direction. These areas correspond to the location of the ears. The relief areas reduce the height and pinching of the ears in the drawn material by reducing or more evenly distributing the clamping forces in those regions.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A draw pad for a cupping press, comprising:

an inner surface defining a draw aperture configured to receive a punch; and a clamping surface having a first force concentrating segment circumferentially separated by a relief area from a second force concentrating segment, each of the force concentrating segments comprising a first arcuate groove radially spaced apart by a first distance from an adjacent second arcuate groove, the relief area having a first arcuate groove radially spaced apart by a second distance from an adjacent second arcuate groove, the second distance being greater than the first distance.

2. The draw pad of claim 1 wherein a first radial width of the arcuate grooves of the force concentrating segments is greater than a second radial width of the arcuate grooves of the relief area.

3. The draw pad of claim 1 wherein the relief area has a circumferential width between 10 and 20 degrees.

4. The draw pad of claim 1 wherein the clamping surface further comprises a third and a fourth force concentrating segment, wherein each of the force concentrating segments is circumferentially separated from a respective adjacent force concentrating segment of the force concentrating segments by a respective relief area.

5. The draw pad of claim 4 wherein each of the relief areas has a circumferential width of between 10 and 20 degrees.

6. The draw pad of claim 5 wherein each of the relief areas has a circumferential width of 15 degrees.

7. The draw pad of claim 1 wherein the inner surface is cylindrical and the clamping surface is circular.

8. The draw pad of claim 1 wherein a first annular row of grooves includes the first arcuate grooves of the force concentrating segments and the first arcuate groove of the relief area, and a second annular row of grooves includes the second arcuate grooves of the force concentrating segments and the second arcuate groove of the relief area.

9. The draw pad of claim 8 wherein the first annular row of grooves and the second annular row of grooves are each circumferentially continuous and concentric to the draw aperture.

10. A draw pad for a cupping press, comprising:

an inner surface defining a draw aperture configured to receive a punch; and a clamping surface configured to hold a blank of material to be formed into a cup, the clamping surface comprising a plurality of annular grooves, each groove being concentric to the draw aperture, and a plurality of relief areas each defined by a depression in the clamping surface disposed adjacent the inner surface.

11. The draw pad of claim 10 wherein the plurality of relief areas comprises four relief areas equally circumferentially spaced apart.

12. The draw pad of claim 11 wherein each of the relief areas is spaced apart approximately 90 degrees from a respective circumferentially adjacent relief area of the relief areas.

13. The draw pad of claim 10 wherein a floor surface of each of the relief areas is concave and tapered to increase in depth toward the inner surface.

14. The draw pad of claim 10 wherein each of the relief areas bisects at least one of the plurality of annular grooves.

15. The draw pad of claim 10 wherein none of the relief areas intersects any of the plurality of annular grooves.

16. The draw pad of claim 10 wherein the inner surface is cylindrical and the clamping surface is circular.

17. The draw pad of claim 10 wherein the plurality of annular grooves is disposed at a radially distal portion of the clamping surface.

18. The draw pad of claim 10 wherein the plurality of annular grooves is disposed at a radially proximal portion of the clamping surface.

19. A method for reducing earing in a drawn cup, comprising:

positioning a sheet of metal between a draw pad and a blank-and-draw die;

clamping the sheet of metal between the draw pad and the blank-and-draw die by contacting a clamping surface of the draw pad to a portion of the sheet of metal, wherein the clamping surface has four force concentrating segments each circumferentially equally spaced apart by a respective relief area from a respective adjacent force concentrating segment of the force concentrating segments, wherein each of the force concentrating segments comprises a first arcuate groove radially spaced apart by a first distance from an adjacent second arcuate groove, and each respective relief area having a first arcuate relief groove radially spaced apart by a second distance from an adjacent second arcuate relief groove, the second distance being greater than the first distance;

shearing the sheet of metal to create a blank having a disk shape; and directing a punch to displace a portion of the blank into a die cavity and forming the blank between the punch and the blank-and-draw die into the drawn cup.

20. The method of claim 19 wherein the sheet of metal is anisotropic and has a rolling direction.

21. The method of claim 20 wherein each of the respective relief areas is disposed offset 45 degrees from the rolling direction.

22. The method of claim 19 wherein the sheet of metal comprises aluminum.

* * * * *